US005914308A

United States Patent [19]

Morris et al.

[11] Patent Number: 5,914,308

[45] Date of Patent: Jun. 22, 1999

[54] PROCESS FOR AGGLOMERATING DETERGENT POWDERS

[75] Inventors: Timothy C. Morris, Ridley, Pa.; J. Frederick Hessel, Metuchen, N.J.

[73] Assignee: Henkel Corporation, Plymouth Meeting, Pa.

[21] Appl. No.: 08/735,471

[22] Filed: Oct. 23, 1996

[51] Int. Cl.[6] ..... C11D 11/00

[52] U.S. Cl. ..... 510/444; 510/224; 510/276; 510/356; 510/470

[58] Field of Search ..... 510/444, 470, 510/224, 276, 356

[56] References Cited

U.S. PATENT DOCUMENTS

| | | | |
|---|---|---|---|
| 4,536,317 | 8/1985 | Llenado et al. | 252/174.17 |
| 4,536,319 | 8/1985 | Payne | 252/174.17 |
| 4,726,908 | 2/1988 | Kruse et al. | 252/91 |
| 4,861,510 | 8/1989 | Wilms et al. | 252/174.13 |
| 5,266,690 | 11/1993 | McCurry, Jr. et al. | 536/18.6 |
| 5,318,733 | 6/1994 | Carduck et al. | 264/15 |
| 5,397,507 | 3/1995 | Bauer et al. | 252/549 |
| 5,489,392 | 2/1996 | Capeci et al. | 510/444 |
| 5,516,447 | 5/1996 | Bauer et al. | 510/444 |
| 5,536,431 | 7/1996 | Carduck et al. | 510/444 |
| 5,616,550 | 4/1997 | Kruse et al. | 510/444 |

FOREIGN PATENT DOCUMENTS 9319155 9/1993 WIPO .

*Primary Examiner*—Lorna Douyon
*Attorney, Agent, or Firm*—Ernest G. Szoke; Wayne C. Jaeschke; Steven J. Trzaska

[57] ABSTRACT

A process for producing detergent agglomerates useful in the production of detergent granules, comprising: (a) providing at least one solid, powder-form detergent component; (b) providing an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6; and (c) applying the alkyl polyglycoside onto the detergent component to form a detergent agglomerate product.

5 Claims, No Drawings

PROCESS FOR AGGLOMERATING DETERGENT POWDERS

FIELD OF THE INVENTION

The present invention generally relates to a process for making detergent agglomerates. More particularly, the invention is directed to the use of an alkyl polyglycoside as a processing binder in the manufacture of detergent agglomerates.

BACKGROUND OF THE INVENTION

The use of coarse-grained material instead of finely divided powder-form material has a number of advantages in terms of handling. Because of this, many powder-form materials are converted into coarse-grained materials, for example, into granules, with liquid in addition to powder-form auxiliaries frequently being used as binders. If the auxiliaries are inert, the content of binders in the granulate should be kept as small as possible. In many cases, however, finely divided and liquid active materials have to be converted into a granular, free-flowing product which feels dry. In this context, it is often desirable to be able to produce granular products containing a relatively high percentage of liquid constituents. Unfortunately, the incorporation of relatively large quantities of liquid constituents generally leads to moist products with poor flow properties and poor retention of liquid components leading to release of liquids, known in the art as "nonionic bleeding".

SUMMARY OF THE INVENTION

The present invention is directed to a process for producing detergent agglomerates useful in the production of detergent granules, involving the steps of:

(a) providing at least one solid, powder-form detergent component;

(b) providing an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6; and (c) applying the alkyl polyglycoside onto the detergent component to form detergent agglomerates.

DESCRIPTION OF THE INVENTION

Other than in the operating examples, or where otherwise indicated, all numbers expressing quantities of ingredients or reaction conditions used herein are to be understood as being modified in all instances by the term "about".

It has been surprisingly found that alkyl polyglycosides, when uniformly applied onto conventional solid, powder-form detergent components, form agglomerates having a homogeneous composition which are useful for laundry and other detergent/cleaning product applications. The alkyl polyglycosides act as binders during the agglomeration process thereby promoting the ultimate formation of finished, ready-to-use detergent granules.

Any conventional detergent components may be used according to the process of the invention, so long as at least one of them is in a solid, powder form. Examples thereof include, but are not limited to, surfactants, builders, and other detergent constituents. Surfactants which may be employed in the present invention typically contain at least one hydrophobic organic radical and a water-solubilizing anionic, zwitterionic, or nonionic group in the molecule. The hydrophobic radical is generally an aliphatic hydrocarbon radical containing from about 8 to about 26, preferably from 10 to 22, and most preferably from 12 to 18 carbon atoms, or an alkyl aromatic radical containing from about 6 to about 18 and preferably from 8 to 16 aliphatic carbon atoms.

Suitable anionic surfactants include, for example, soaps of natural or synthetic origin, and preferably from saturated, fatty acids. Suitable synthetic anionic surfactants include those of the sulfonate, sulfate and synthetic carboxylate type.

Suitable surfactants of the sulfonate type include alkyl benzenesulfonates, olefin sulfonates, i.e., mixtures of alkene and hydroxyalkane sulfonates and also disulfonates of the type obtained, for example, from $C_{18}$ mono-olefins containing a terminal or internal double bond by sulfonation with gaseous sulfur trioxide and subsequent alkaline and/or acidic hydrolysis for the sulfonation products. Also suitable are the alkane sulfonates obtainable from $C_{18}$ alkanes by sulfochlorination or sulfoxidation and subsequent hydrolysis or neutralization or by bisulfite addition to olefins and esters of alpha-sulfo-fatty acids, for example, alpha-sulfonated methyl or ethyl esters of hydrogenated coconut oil, palm kernel oil and tallow fatty acids.

Suitable surfactants of the sulfate type include the sulfuric acid monoesters of primary alcohols of natural and synthetic origin, i.e., of fatty alcohols such as, for example, coconut oil fatty alcohols, tallow fatty alcohols, oleyl alcohol, lauryl, myristyl, palmityl or stearyl alcohol or the $C_{10-20}$ oxoalcohols and secondary alcohols of the same chain length. Sulfuric acid monoesters of aliphatic primary alcohols ethoxylated with from 1 to 6 moles of ethylene oxide, ethoxylated secondary alcohols and alkylphenols are also suitable. Sulfated fatty acid alcohol amides and sulfated fatty acid monoglycerides are also suitable.

Other suitable anionic surfactants include the fatty acid esters and amides of hydroxycarboxylic or amino-carboxylic acids and sulfonic acids, such as for example fatty acid sarcosides, glycolates, lactates, taurides and isethionates.

The anionic surfactants may be present in the form of their sodium, potassium, and ammonium salts and also as soluble salts of organic bases, such as mono-, di- or tri-ethanolamine.

Suitable nonionic surfactants include adducts of from 1 to 40 and preferably from 2 to 20 moles of ethylene oxide with 1 mole of a compound containing 8 to 20 carbon atoms selected from the group consisting of alcohols, alkylphenols, fatty acids, fatty amines, fatty acid amides or alkane sulfonamides. Others include $C_{8-20}$ linear alkoxylate adducts of ethylene and propylene oxide, n-methyl glucosamides and other sugar surfactants. Of particular importance are the adducts of from 8 to 80 moles of ethylene oxide with a primary alcohol, such as for example coconut oil or tallow fatty alcohol with oleyl alcohol, with an oxoalcohol or with a secondary alcohol containing from 8 to 18 carbon atoms in the alkyl radical.

Zwitterionic surfactants which may be used are preferably derivatives of aliphatic quaternary ammonium compounds, in which one of the aliphatic radicals consists of a $C_{8-18}$ radical while another contains an anionic, water solubilizing carboxy, sulfo or sulfato group.

Other detergent ingredients which may be employed in the process of the invention include, builders of either the organic or inorganic variety, bleaching compounds, optical brighteners, foam regulators, and the like.

The alkyl polyglycosides which can be used in the compositions according to the invention are represented by formula I:

$$R_1O(R_2O)_b(Z)_a \quad (I)$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. GLUCOPON® 220 Surfactant—an alkyl polyglycoside in which the alkyl group contains 8 to 10 carbon atoms and having an average degree of polymerization of 1.5–1.6.
2. GLUCOPON® 425 Surfactant—an alkyl polyglycoside in which the alkyl group contains 8 to 16 carbon atoms and having an average degree of polymerization of 1.48.
3. GLUCOPON® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.5.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—an alkyl polyglycoside in which the alkyl group contains 8 to 16 carbon atoms and having an average degree of polymerization of 1.4.
7. PLANTAREN® 1300 Surfactant—an alkyl polyglycoside in which the alkyl group contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The process of the present invention relates to the formation of agglomerates useful in the production of free-flowing, finished detergent granules. The process involves uniformly applying an alkyl polyglycoside of formula I, in solution or melt form, i.e., either a pure alkyl polyglycoside and/or a combination of an alkyl polyglycoside plus a nonionic surfactant other than an alkyl polyglycoside, onto at least one solid, powder-form detergent component. The alkyl polyglycoside component may be applied onto the powder-form detergent component(s) in any conventional manner such as, for example, spraying.

In a particularly preferred embodiment, the alkyl polyglycoside is preferably one wherein in formula I $R_1$ is a monovalent organic radical having from about 10 to about 16 carbon atoms, b is zero, and a is a number having a value of from about 1.2 to about 1.8. The alkyl polyglycoside is applied onto the powder-form detergent component(s) at a concentration ranging from about 2 to about 10% by weight, based on the weight of the agglomerate product. Aside from the solid, powder-form detergent component(s) and the alkyl polyglycoside component, the agglomerate will additionally contain water in an amount ranging from about 0.5 to about 10% by weight, based on the weight of the agglomerate product. The alkyl polyglycoside component provides both binding and solubilizing properties to the resultant agglomerates, while at the same time exhibiting less gelling and enhanced water solubility. Optionally, additional binders/processing aids, either aqueous such as silicates and polymers, or non-aqueous may also be employed, if desired.

Once the detergent agglomerates are formed they may then, if desired, be mixed with other detergent components, whether in solid or liquid form. The agglomeration process is used to manufacture finished, ready-to-use detergent granules. An agglomerating apparatus such as, for example, a Schugi mixer may be employed in order to agglomerate the detergent agglomerates. Once formed, the agglomerates may then be dried in order to remove any excess/unwanted moisture from the agglomerates, thus forming finished, ready-to-use detergent granules. The process of the invention may be used when forming a variety of ready-for-use detergent granules. Examples of such ready-to-use detergent granules include, but are not limited to, those used as laundry detergents, machine dishwashing detergents, and the like.

What is claimed is:

1. A process for producing detergent agglomerates useful in the production of detergent granules, comprising:

(a) providing at least one solid, powder-form detergent component;

(b) providing an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6; and (c) spraying the alkyl polyglycoside onto the detergent component to form a detergent agglomerate product.

2. The process of claim 1 wherein in formula I $R_1$ is a monovalent organic radical having from about 10 to about 16 carbon atoms, b is zero, and a is a number having a value of from about 1.2 to about 1.8.

3. The process of claim 1 wherein the alkyl polyglycoside is sprayed onto the detergent component at a concentration of from about 2 to about 10% by weight, based on the weight of the agglomerate product.

4. The process of claim 1 wherein the detergent agglomerate product further contains from about 0.5 to about 10% by weight water, based on the weight of the agglomerate product.

5. The process of claim 1 further comprises subsequently granulating the detergent agglomerate product to form detergent granules.

* * * * *